US005383104A

United States Patent [19]

Hou

[11] Patent Number: 5,383,104

[45] Date of Patent: Jan. 17, 1995

[54] RENOVATED FLASHLIGHT

[76] Inventor: Hsien-Te Hou, No. 5, Lane 279, Chung Cheng Rd., Yung Kang City, Tainan Hsien, Taiwan, Prov. of China

[21] Appl. No.: 76,638

[22] Filed: Jun. 15, 1993

[51] Int. Cl.[6] ..... F21L 9/00

[52] U.S. Cl. ..... 362/202; 362/203; 362/205

[58] Field of Search ..... 362/202, 203, 205, 208, 362/204, 188; 200/60

[56] References Cited

U.S. PATENT DOCUMENTS

| | | | |
|---|---|---|---|
| 1,254,114 | 1/1918 | Benedict | 362/205 |
| 3,076,891 | 2/1963 | Moore | 362/202 |
| 4,286,311 | 8/1981 | Maglica | 362/202 |
| 4,658,336 | 4/1987 | Maglica | 362/203 |
| 4,821,156 | 4/1989 | Siefert et al. | 362/205 |
| 5,138,537 | 8/1992 | Wang | 362/202 |

FOREIGN PATENT DOCUMENTS

| | | | |
|---|---|---|---|
| 654021 | 7/1962 | Canada | 362/203 |

*Primary Examiner*—Ira S. Lazarus
*Assistant Examiner*—Y. Quach
*Attorney, Agent, or Firm*—Bacon & Thomas

[57] ABSTRACT

A renovated flashlight includes a head means and a cylindrical battery compartment. The head means is composed of a lid, a reflecting means, a spring means, and a conducting means. The reflecting means has a hollow body at bottom portion adopted to receive the spring means, and the conducting means therein. A longitudinal slot is formed at one side of the hollow body for a negative conducting plate to extend therefrom.

5 Claims, 3 Drawing Sheets

RENOVATED FLASHLIGHT

FIELD OF THE INVENTION

This invention relates to a renovated flashlight. More particularly, a flashlight includes an adjustable head to fit batteries of various length.

BACKGROUND OF THE INVENTION

Flashlights of prior art are, in general, composed of a head detachably connected to a battery compartment. The battery compartment is designed to hold batteries to provide power to light the flash up. However, the compartment can only receive only the battery of only one size. Any other size will not fit into the battery compartment.

In view of this inventor has invented the present invention which includes a battery compartment which interior length is adjustable to fit batteries of various length.

SUMMARY OF THE INVENTION

It is the primary object of the present invention to provide a renovated flashlight which battery compartment is adjustable to receive batteries of various length.

It is another object of the present invention to provide a renovated flashlight which improves a good conduction of the battery.

It is a further object of the present invention to provide a renovated flashlight which has less parts and reduces cost of production.

BRIEF DESCRIPTION

DETAILED DESCRIPTION OF THE PREFERRED EMBODIMENT

Figure 1:
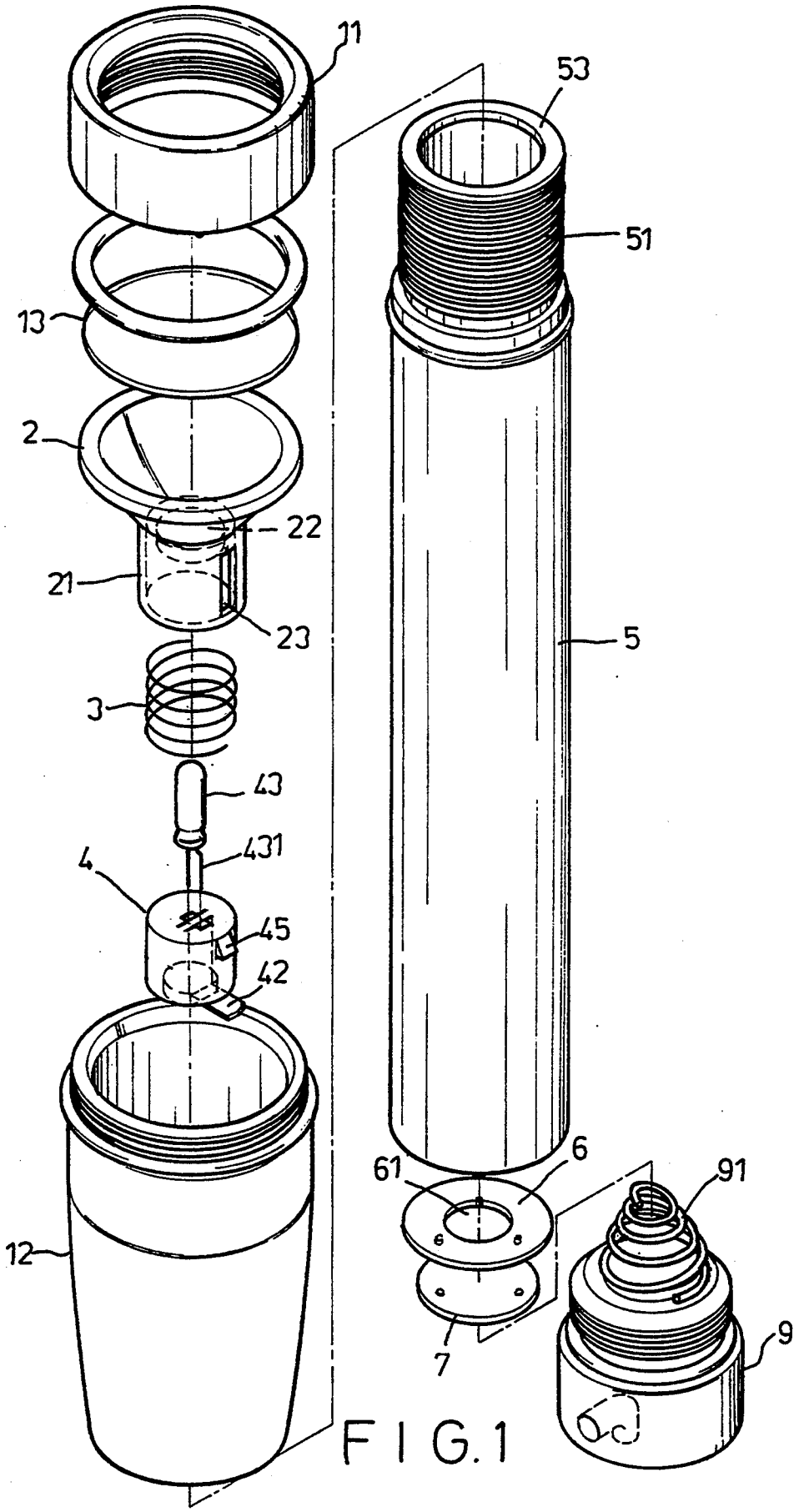
FIG. 1 is a fragmentary view of the present invention.

Reference is now made to the present invention wherein each drawings is for the purpose of illustrated only and not for the purpose of limiting the same, FIG. 1 shows the present invention composed essentially of a head means 1, a reflecting means 2 detachably attached within the interior of the head means 1, and a battery compartment 5.

The head means 1 includes a lid 11 rotatably connected to hollow barrel 12. Detachably enclosed within the hollow barrel 12 is a lens 13, the reflecting means 2, a spring means 3, and a conducting means 4, sequentially. The lid 11 has female threads at inner portion adapted to be threaded connected with male threads of the hollow barrel 12. The reflecting means 2 shaped like a speaker has a cylindrical body 21 at bottom portion thereof including a bore 22 adapted to receive spring means 3 and the conducting means 4 therein , and a pair of slots 23 at opposite sides thereof. The spring means 3 rests in the bore 22 and seats immediately on top of the conducting means 4. The conducting means 4, cylindrical in shape, has a positive potential plate 41, a negative potential plate 42 with a bottom portion protruding from one side of the conducting means 4, and two slots at top portion adapted to receive the positive and negative terminals 431 of a bulb 43, respectively. A pair of protuberances 45 at opposite sides of the conducting means 4 will extend from the slots 23 of the reflecting means 2, outwardly to hold the conducting means 4 in place when, the head 1 is rotated to adjust its length.

The battery compartment 5 cylindrical in shape has a male threads 51 at top portion adapted to be threaded connected with a female threads of the head barrel 12 and a leading edge 52 which is adapted to be in touch with the negative potential plate 42 of the conducting means 4. A lower cap 9 has a male threads adapted to be threaded connected with a female threads 52 at bottom portion of the battery compartment 5, and a spring 91 at top portion thereof. An insulator 6 and a conductor 7 are placed immediately underneath the conducting means 4 with the positive conducting plate 41 extending through a bore 61 in the insulator 6 and in touch with one side of the conductor 7 whereas the other side of the conductor 7 is in touch with the positive end of a battery 8.

Figure 2:
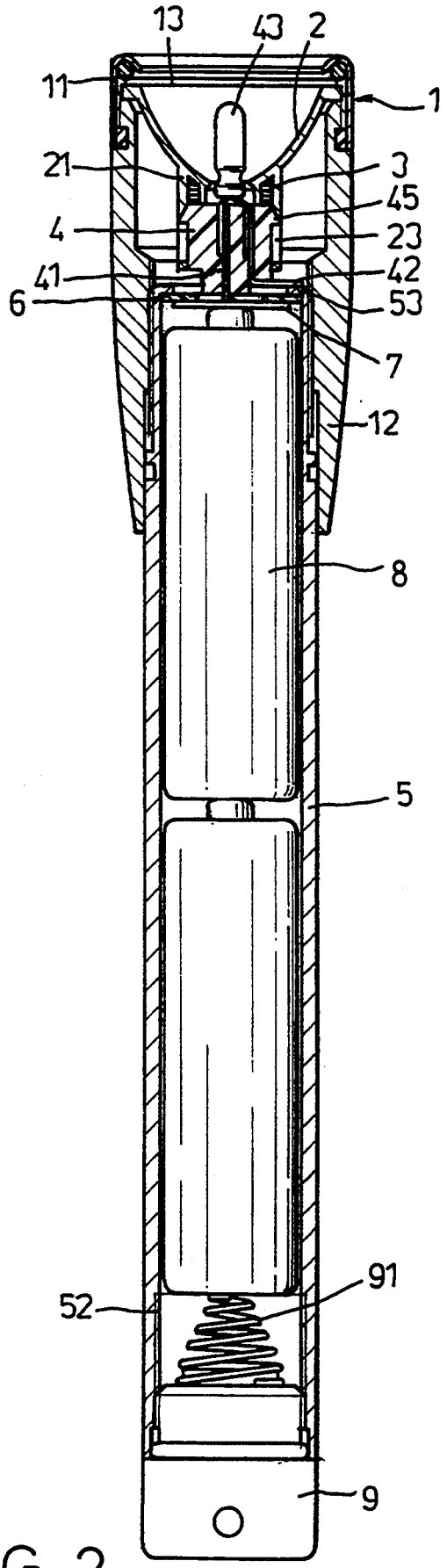
FIG. 2 is a side elevational view of FIG. 1, partially sectioned.

To assemble the present invention, place the bulb 43 on the conducting means 4 with the two terminals inserted into the two slots, insert the spring means 3, the conducting means 4 into the cylindrical body 21. Place the lens 13, the reflecting means 2 into the hollow barrel 12 and thread the lid 11 onto the barrel 12. Insert batteries 8 into the cylindrical body 5 and thread the head means 1 to the top thereof, and the flashlight of the present invention is assembled as shown in FIG. 2.

Figure 3:
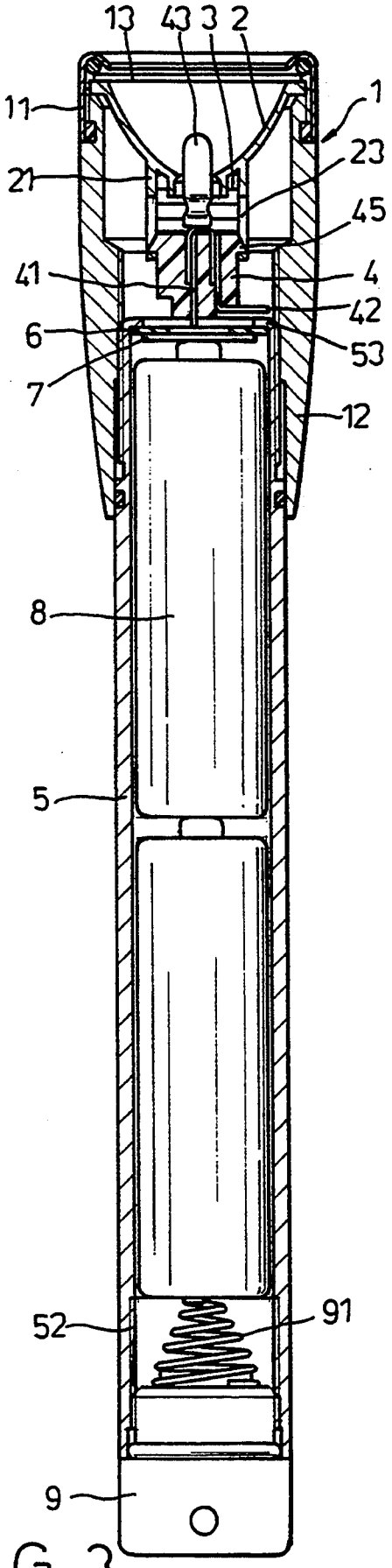
FIG. 3 is a further side elevational view of FIG. 1, showing the flashlight in a disconnecting situation.

To operate the present invention, rotate the head means 1 which brings the lid 11, the lens 13, and the reflecting means 2 upwardly. The conducting means 4 which is biased by the spring means 3, remains at the same position. Therefore, no matter what the length of the battery is, the bulb 43 can always has a good connection with the battery, as shown in FIG. 3.

I claim:

1. A flashlight comprising:

a) a generally cylindrical casing defining a battery compartment having a first end and a second end, the casing configured to receive at least one battery having positive and negative terminals in the battery compartment;

b) a first electrical conductor located adjacent to the first end of the casing and configured so as to electrically contact the positive terminal of a battery located in the battery chamber;

c) a second electrical conductor having a portion located adjacent to the first end of the casing and configured so as to electrically contact the negative terminal of a battery located in the battery chamber;

d) a barrel having a reflector and a lens attached thereto;

e) a bulb assembly having a bulb attached to a conducting means, and first and second potential plates electrically connected to terminal means of the bulb and extending from the conducting means;

f) a pair of slots and an aperture defined by the reflector;

g) a pair of protuberances extending from the conducting means and through the slots such that the bulb assembly may move axially within the aperture with respect to the reflector between a first position wherein the conducting means is closest to the reflector and a second position wherein the conducting means extends away from the reflector;

h) spring means operatively located between the conducting means and the reflector so as to normally bias the conducting means toward its second position; and, i) attachment means attaching the barrel to the first end of the casing such that rotation of the barrel relative to the casing causes axial movement of the barrel relative to the casing in a direction along a longitudinal axis of the casing such that the conducting means can be moved between a position wherein the first and second potential plates are in electrical contact with the first and second electrical conductors, and a position wherein both first and second potential plates are out of contact with the first and second electrical conductors.

2. The flashlight of claim 1 wherein the attachment means comprises:

a) first threads formed on the first end of the generally cylindrical casing; and, b) second threads formed on the barrel so as to engage the first threads.

3. The flashlight of claim 1 wherein the first electrical conductor comprises a generally cylindrical plate and further comprising an electrical insulator disposed between the circular plate and the casing.

4. The flashlight of claim 1 wherein the second electrical conductor comprises an edge of the generally cylindrical casing extending around the first end of the casing.

5. The flashlight of claim 4 wherein the first electrical conductor comprises a generally circular plate and further comprising an electrical insulator located between the circular plate and the edge of the casing forming the second electrical conductor.

* * * * *